US010909957B2

(12) United States Patent
Trifilio

(10) Patent No.: US 10,909,957 B2
(45) Date of Patent: Feb. 2, 2021

(54) GUITAR EFFECTS PEDALBOARD WITH IMPROVED PEDAL COMPATIBILITY

(71) Applicant: Chemistry Design Werks, LLC, Saint Paul, MN (US)

(72) Inventor: Christian Richard Trifilio, Saint Paul, MN (US)

(73) Assignee: Chemistry Design Werks, LLC, Saint Paul, MN (US)

( * ) Notice: Subject to any disclaimer, the term of this patent is extended or adjusted under 35 U.S.C. 154(b) by 0 days.

(21) Appl. No.: 16/820,305

(22) Filed: Mar. 16, 2020

(65) Prior Publication Data

US 2020/0294480 A1 Sep. 17, 2020

Related U.S. Application Data

(63) Continuation-in-part of application No. 29/683,788, filed on Mar. 15, 2019.

(51) Int. Cl.
*G10H 1/34* (2006.01)
*G10H 1/00* (2006.01)

(52) U.S. Cl.
CPC ..... *G10H 1/348* (2013.01); *G10H 1/0008* (2013.01)

(58) Field of Classification Search
CPC ..... G10H 1/348; G10H 1/0008
See application file for complete search history.

(56) References Cited

U.S. PATENT DOCUMENTS

| | | | | |
|---|---|---|---|---|
| 6,215,055 | B1 * | 4/2001 | Saravis | G10H 1/348 84/422.1 |
| 6,459,023 | B1 * | 10/2002 | Chandler | G10H 1/32 84/177 |
| 7,485,792 | B2 | 2/2009 | Collins | |
| D690,708 | S * | 10/2013 | Smith | D14/447 |
| 8,614,385 | B2 | 12/2013 | McKinney et al. | |
| 8,642,870 | B1 * | 2/2014 | Rosa | A47G 27/0212 84/453 |
| D745,923 | S | 12/2015 | Trifilio | |
| D745,924 | S | 12/2015 | Trifilio | |
| D769,364 | S | 10/2016 | Trifilio | |
| D795,334 | S | 8/2017 | Kreifeldt et al. | |
| D815,682 | S | 4/2018 | Trifilio et al. | |
| 10,008,192 | B2 * | 6/2018 | Kreifeldt | G10H 1/348 |
| D824,993 | S | 8/2018 | Trifilio | |
| D828,440 | S | 9/2018 | Trifilio | |
| D831,103 | S | 10/2018 | Trifilio | |
| 10,163,430 | B2 * | 12/2018 | Jashyn | G10H 1/348 |
| 10,204,609 | B2 | 2/2019 | Grifols | |

(Continued)

FOREIGN PATENT DOCUMENTS

GB 2544517 A 5/2017

OTHER PUBLICATIONS

The Les Paul Forum, https://www.lespaulforum.com/forum/showthread.php?162077-A-Better-Alternative-To-Velcro, Oct. 2, 2009.

*Primary Examiner* — Jeffrey Donels
(74) *Attorney, Agent, or Firm* — Campbell IP Law LLC

(57) ABSTRACT

A guitar effects pedalboard comprises a first attachment region and a second attachment region, the first attachment region comprising a plurality of holes having a first diameter, and the second attachment region comprising a plurality of holes having a second diameter, wherein the first diameter is smaller than the second diameter.

18 Claims, 15 Drawing Sheets

(56) References Cited

U.S. PATENT DOCUMENTS

| | | | | | |
|---|---|---|---|---|---|
| D862,582 | S | * | 10/2019 | Lackner | D17/20 |
| D862,583 | S | * | 10/2019 | Lackner | D17/20 |
| 2011/0271821 | A1 | * | 11/2011 | McKinney | G10H 1/348 84/746 |
| 2017/0098438 | A1 | | 4/2017 | Trifilio | |
| 2017/0140744 | A1 | | 5/2017 | Kreifeldt et al. | |
| 2017/0206879 | A1 | | 7/2017 | Fiden et al. | |
| 2017/0243572 | A1 | | 8/2017 | Trifilio | |
| 2018/0151162 | A1 | | 5/2018 | McKenzie | |
| 2018/0301131 | A1 | | 10/2018 | Jashyn | |
| 2020/0027433 | A1 | * | 1/2020 | Wilfer | G10G 5/00 |

* cited by examiner

GUITAR EFFECTS PEDALBOARD WITH IMPROVED PEDAL COMPATIBILITY

PRIORITY CLAIMS

This application claims the benefit of U.S. Design application Ser. No. 29/683,788 filed Mar. 15, 2019, the entirety of which is hereby incorporated by reference into this application.

FIELD OF THE DISCLOSURE

The present disclosure relates in general to guitar effects pedalboards, and more particularly, relates to a pedalboard having improved compatibility with a variety of guitar effects pedals having differing dimensions and orientations.

BACKGROUND

When playing and recording music, musicians often utilize effects units and other devices to alter the sound of their instrument or audio source. For example, guitar players may utilize a variety of effects pedals to alter the sound of their guitar, with each pedal providing unique effects and audio processing capabilities. When used in combination, guitarists can chain together multiple effects to create unique sounds, as well as turn each pedal effect on or off selectively for a more dynamic performance.

In order to organize and secure multiple effects pedals, guitarists routinely utilize a pedalboard upon which each pedal can be secured via fasteners in a preferred arrangement. Fasteners may include, for example, hook and loop type fasteners (e.g., Velcro), wherein the hook side may be attached to the pedalboard surface using an adhesive backing, while the loop side is attached to the guitar effects pedal also with an adhesive backing. A common design for such a pedalboard compatible with hook and loop fasteners is disclosed in U.S. Pat. No. 6,459,023 by Chandler. This enables easy removal or interchanging of pedals from the board surface, but to remove the fastener itself is cumbersome and may leave behind a messy adhesive residue and may also in some cases damage the surface finish or paint on the pedal itself. Removal of the hook and loop fastener itself is often necessitated because the size and positioning of the fastener strip is not always accommodating for pedals of different sizes and dimensions. Further, guitar effects pedals are often viewed as a collector's item by many enthusiasts, and therefore some users are highly reluctant to affix adhesive strips to their pedals due to the above concerns.

Accordingly, pedalboards have also been designed with a plurality of through-holes in the board, enabling a cable tie to be threaded between two holes and tightened around a pedal to secure it against the board surface. Such cable ties do not require any adhesive, and can be easily removed by being cut, thereby enabling the user to more easily rearrange and interchange pedals whenever desired. An example of such pedalboards includes those taught in U.S. Pat. Nos. 9,691,369 and 9,997,149 by Trifilio.

However, some users find the advantages of hook and loop fasteners still outweigh the disadvantages, or they have already affixed such a fastener to some of their pedals and want to have the option to continue to use that fastener and avoid the cumbersome and somewhat risky prospect of removing it. In such cases, a user may wish to have the option to utilize both hook and loop as well as cable tie fasteners on the same board for different pedals. Unfortunately, for a board containing many through-holes, the available surface area between holes may not be sufficient to secure adhesive hook and loop fasteners to the board surface.

Further, boards featuring through-holes typically consist of holes that are of the same size (e.g. diameter) and/or shape and which are evenly distributed across the board surface. Because effects pedals can come in many different sizes and orientations, it can sometimes be challenging to flexibly and securely fit a combination of pedals in the desired arrangement using cable ties when the size, shape and spacing of those holes are not optimal for one or more of the pedals.

SUMMARY OF THE INVENTION

This summary is provided to introduce a selection of concepts that are further described below in the detailed description. This summary is not intended to identify key or essential features of the claimed subject matter, nor is it intended to be used as an aid in limiting the scope of the claimed subject matter.

The present disclosure relates to guitar effects pedalboards for securing multiple guitar effects pedals having differing sizes and orientations to the same board surface.

In an illustrative but non-limiting example, the disclosure provides a guitar effects pedalboard comprising a first attachment region and a second attachment region, the first attachment region comprising a plurality of holes having a first diameter, and the second attachment region comprising a plurality of holes having a second diameter, wherein the first diameter is smaller than the second diameter.

In some examples, the disclosure provides hole dimensions, spacings and attachment regions which may be utilized on any guitar effects pedalboard design to improve its functionality for accommodating almost any commercially available guitar effects pedal having a variety of shapes and orientations.

In other examples, the disclosure provides a modular pedalboard system utilizing the attachment regions with optimized hole dimensions and spacings.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
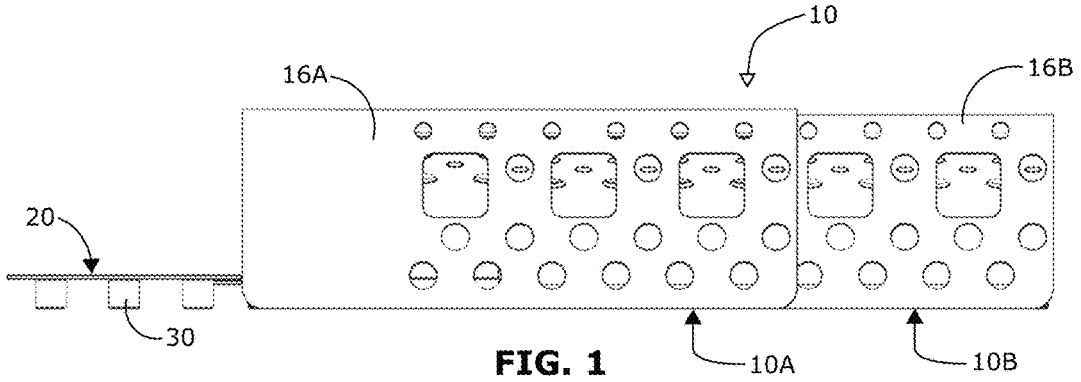
FIG. 1 is a back side view of a guitar effects pedalboard.
Figure 2:
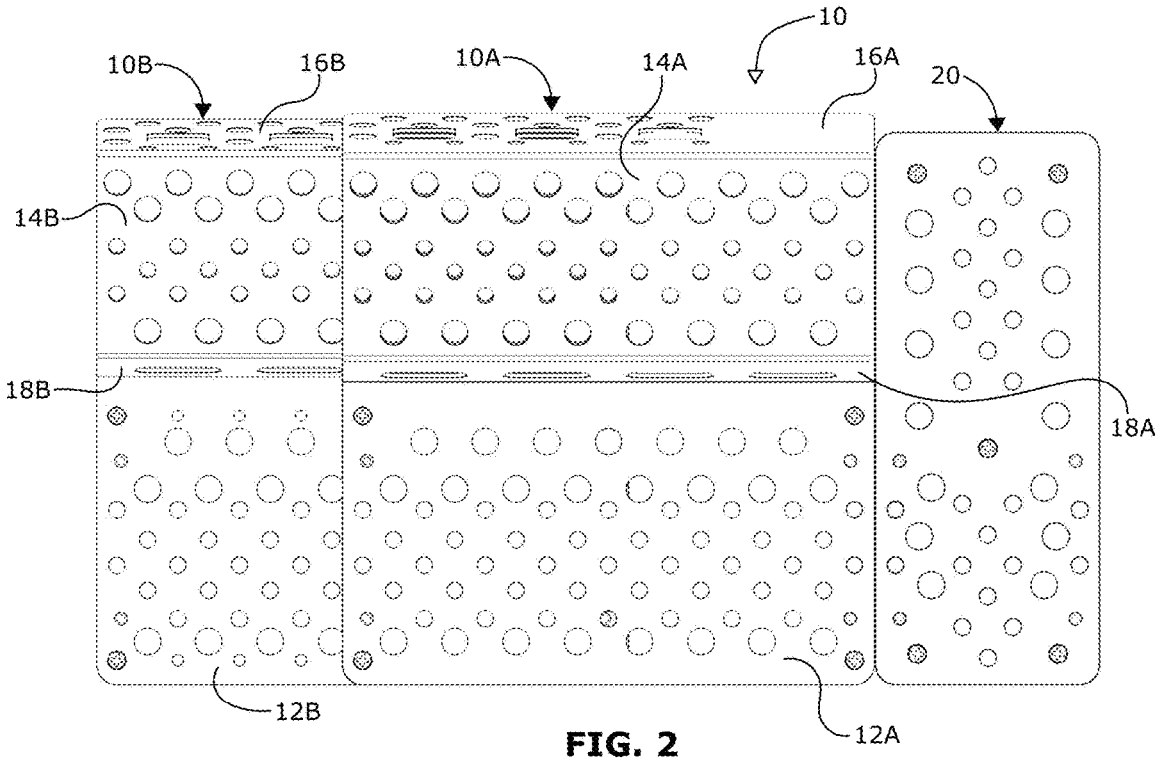
FIG. 2. is a top view of a guitar effects pedalboard.
Figure 3:
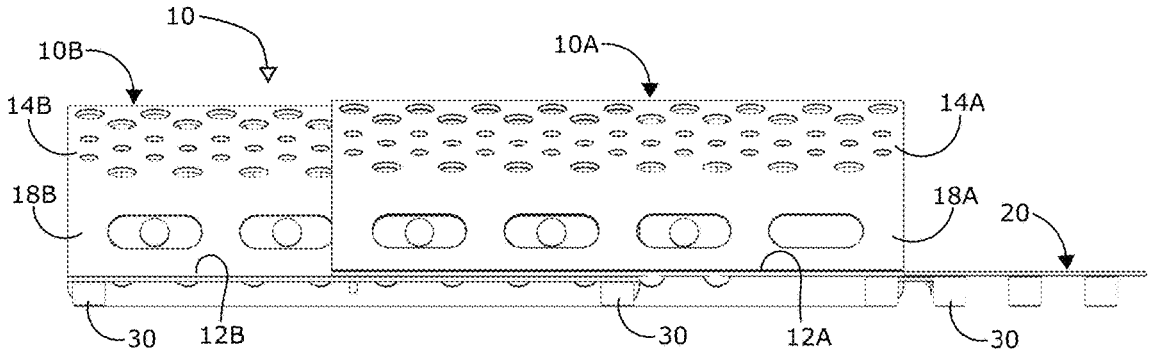
FIG. 3 is a front view of a guitar effects pedalboard.
Figure 4:
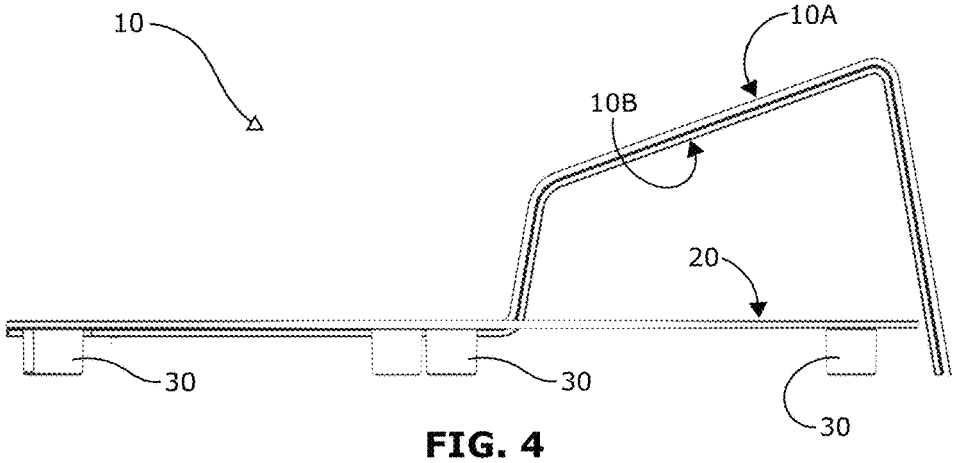
FIG. 4 is a right side view of a guitar effects pedalboard.
Figure 5:
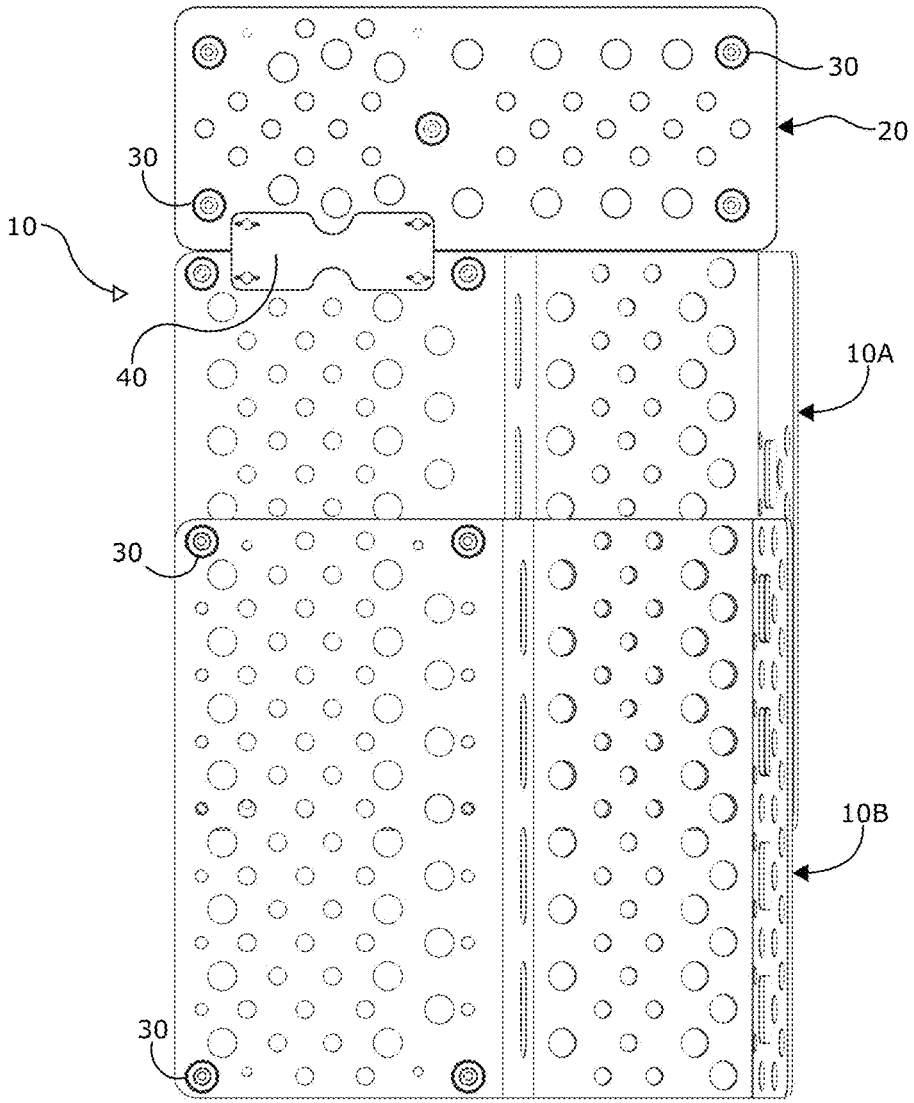
FIG. 5 is a bottom view of a guitar effects pedalboard.
Figure 6:
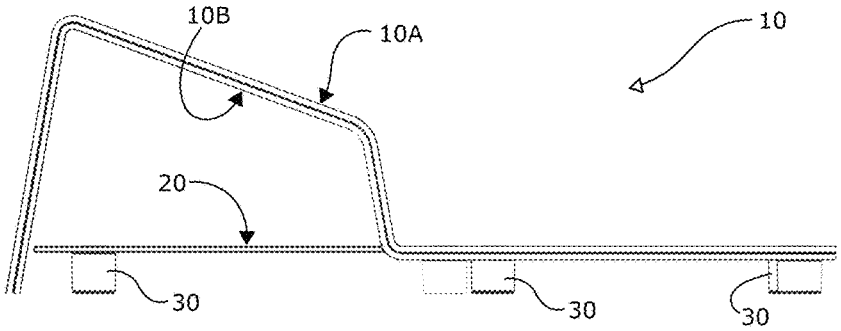
FIG. 6 is a left side view of a guitar effects pedalboard.
Figure 7:
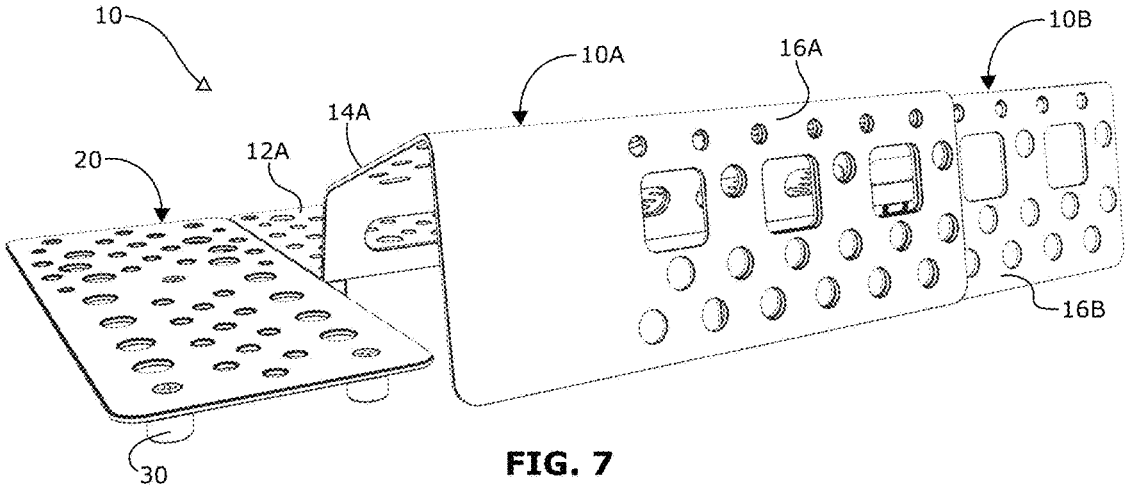
FIG. 7 is a back perspective view of a guitar effects pedalboard.
Figure 8:
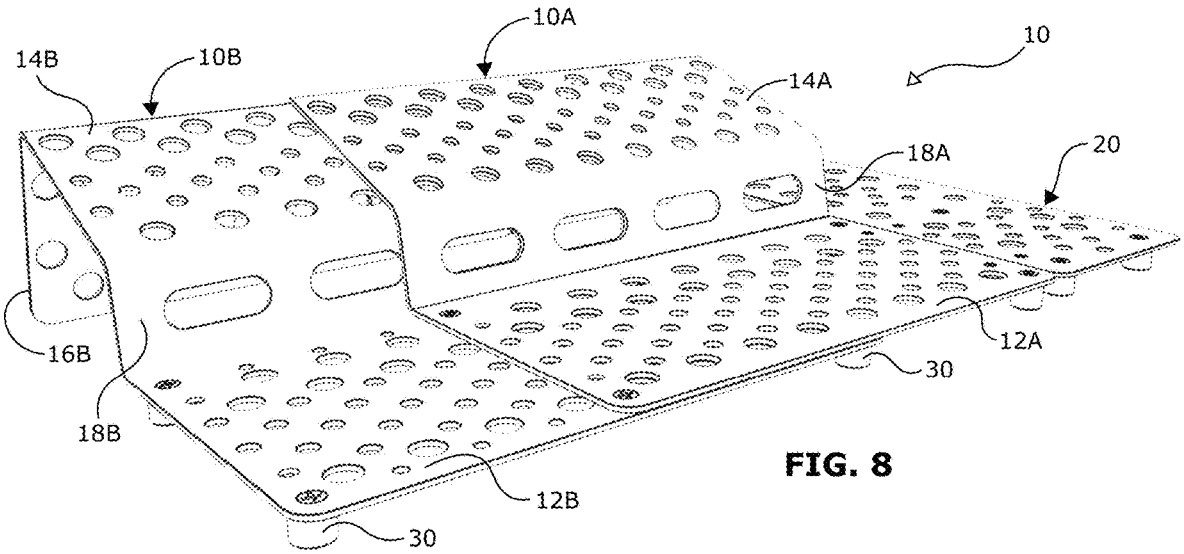
FIG. 8 is a front perspective view of a guitar effects pedalboard.
Figure 9:
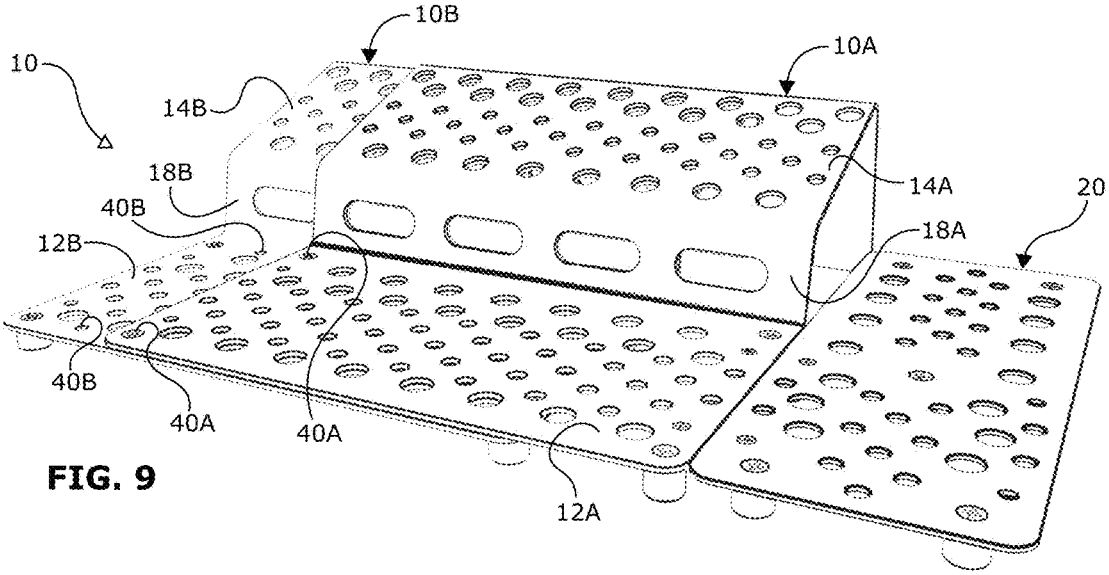
FIG. 9 is a front perspective view of a guitar effects pedalboard prior to being extended.
Figure 10:
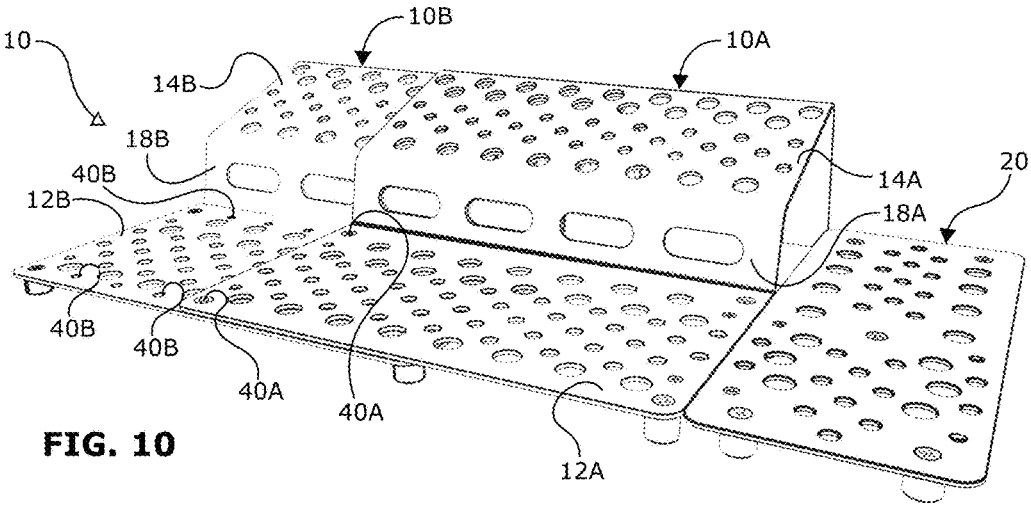
FIG. 10 is a front perspective view of a guitar effects pedalboard partially extended.
Figure 11:
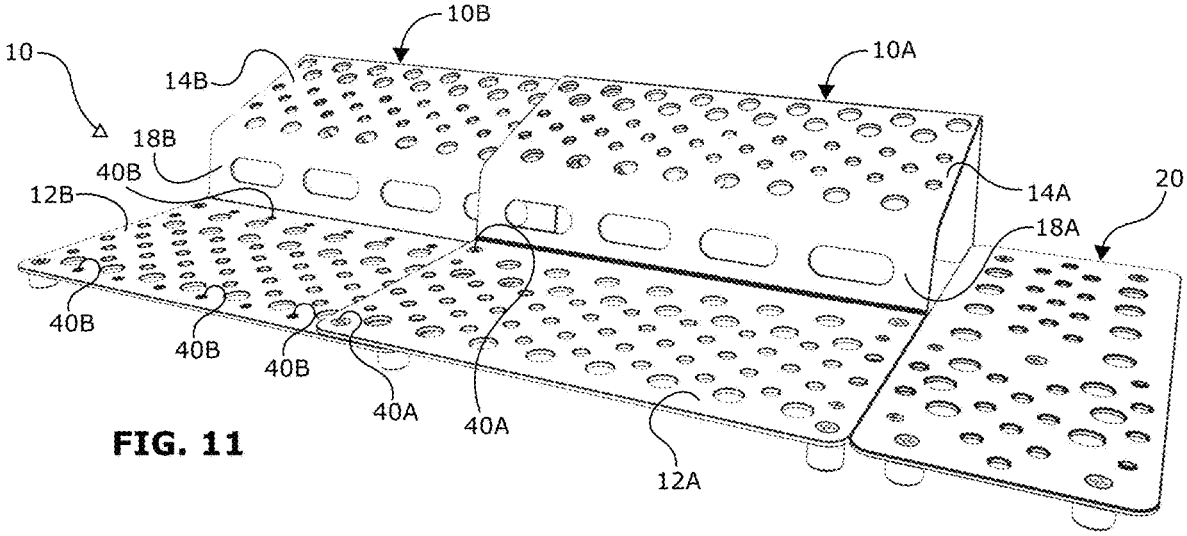
FIG. 11 is a front perspective view of a guitar effects pedalboard fully extended.

Disclosed herein is an improved guitar effects pedalboard having different regions configured to enable the use of both hook and loop fasteners as well as cable ties to secure guitar effects pedals to the board, as well providing optimized hole dimensions and spacings for each region to enable the flexible securement of a combination of guitar pedals having a wide variety of sizes to the board surface in any orientation and configuration.

Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements; those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

FIGS. 1-8 are views of a modular pedalboard system 10 according to an aspect of the present disclosure, including respective views of the back side, top, front, right side, bottom, left side, rear perspective and front perspective. A first pedalboard 10A having slightly larger overall dimensions may overlay a second pedalboard 10B having slightly smaller dimensions, as shown, in a nested relationship. This can be seen, for example, in the right side and left side views of FIGS. 4 and 6, wherein the slightly smaller pedalboard 10B is nested inside pedalboard 10A such that their surfaces are interfaced.

Further shown are base level 12A and upper level 14A of first pedalboard 10A, and base level 12B and upper level 14B of second pedalboard 10B. The base and upper level of each pedalboard 10A, 10B are formed integrally with one another, thereby eliminating the need for assembly of the upper level to the base via fasteners or otherwise, and resulting in a robust and aesthetically pleasing construction. For example, when pedalboard system 10, including pedalboards 10A and 10B, is constructed of a metal such as aluminium, the upper level of each pedalboard (14A, 14B) may be formed integrally with the base level (12A, 12B) through bending of the aluminum sheet into the desired shape.

A plurality of holes of differing sizes in different attachment regions of the pedalboards 10A or 10B is also shown in both base levels (12A, 12B) and upper levels (14A, 14B), but optionally the holes may also be present in just the base or upper levels of either pedalboard 10A or 10B. Details on the optimized dimensions, functionality and other features of the holes are described further with reference to FIGS. 17-34 of the present application.

Although two pedalboards 10A and 10B are depicted in a nested or overlapped relationship in FIGS. 1-8 (as well as FIGS. 9-16), either of pedalboards 10A and 10B may be used completely independent and separate from one another to secure guitar effects pedals depending on the needs of the user, and may be designed with the same hole patterns and features, except that 10B has slightly smaller overall dimensions in order to nest flush against the undersurface of 10A. Further, the dimensions and patterns of the holes of 10A are the same for 10B, and the boards are configured such that when in a nested relationship, the holes of both boards are perfectly coaxial and aligned to facilitate the use of cable ties, for example. By providing a first pedalboard 10A and second pedalboard 10B, as well as optional extension 20, a modular pedalboard 10 system is enabled whereby the user can not only add or subtract additional pedal attachment capabilities as needed, but can also flexibly adjust the exact width of the overall pedalboard 10 and available attachment areas through the overlapping and telescoping relationship of the two pedalboards 10A, 10B. This provides an advantage over traditional modular systems where the available attachment area can only be added in an all-or-nothing manner, rather than in controllable telescoping increments.

Feet 30 are shown attached to the underside of pedalboards 10A, 10B, as well as optional extension 20. Feet 30 may comprise rubber feet, for example, that are secured to the pedalboard with screws. Optionally, pedalboards 10A and 10B may be utilized without feet and directly rest upon a floor or other suitable surface.

Extension 20 is compatible with and may be attached to either pedalboard 10A or 10B, though it is shown attached to 10A in the figures. The attachment may be achieved using connector 40 (shown in FIG. 5) which may comprise a metal plate with screws. In the case of either pedalboard 10A or 10B used independently, extension 20 may be attached to either the right or left side of the pedalboard, or two extensions 20 may be attached to a single pedalboard with one on each side. Extension 20 is an accessory component, and may be used for securing larger guitar pedals such as volume and wah pedals to further enhance the modularity of pedalboard system 10. Extension 20 also comprises a plurality of holes of differing diameters in different attachment regions, thereby enabling both cable tie as well as hook and loop attachment of various pedal sizes and orientations as described in further detail herein.

Further shown is back side 16A of pedalboard 10A and back side 16B of pedalboard 10B. Back side 16A, 16B comprises a hole pattern to enable cable tie attachment of a power source or power brick to the pedalboard(s), and further includes large rectangular holes to facilitate and organize the routing of power cords, including smaller voltage cords, that are used to connect the power source to each effects pedal on the board.

Additionally, riser section 18A of pedalboard 10A and riser section 18B of pedalboard 10B are shown. Riser sections 18A, 18B are a transitional section connecting base level 12A, 12B and upper level 14A, 14B for each pedalboard 10A, 10B. Riser section 18A, 18B is shown with large oblong holes to facilitate and organize the routing of power cords, including smaller voltage cords, from a power source to each pedal attached to the board(s).

Figure 12:
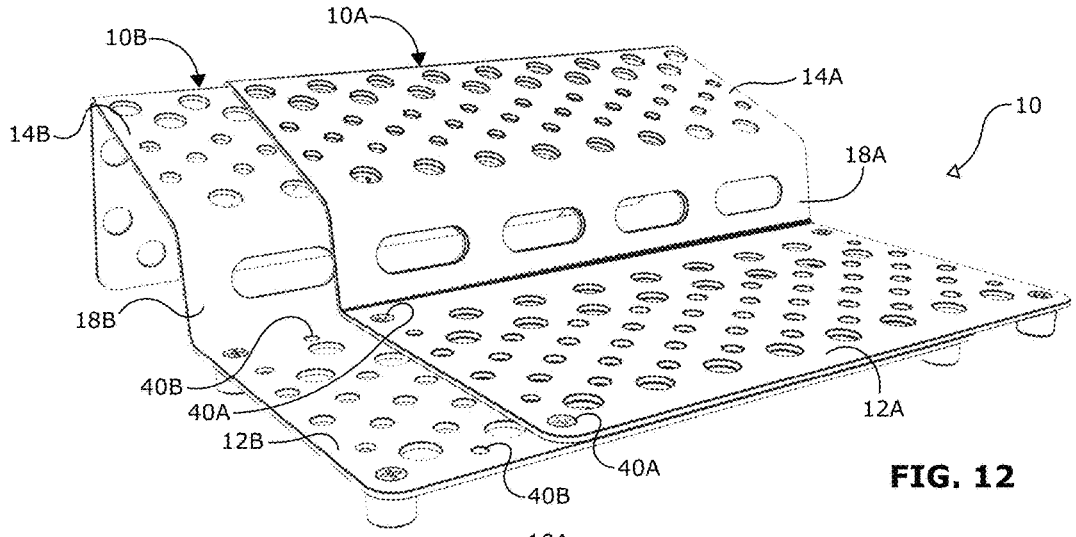
FIG. 12 is a front perspective view of an alternative embodiment of a guitar effects pedalboard prior to being extended.
Figure 13:
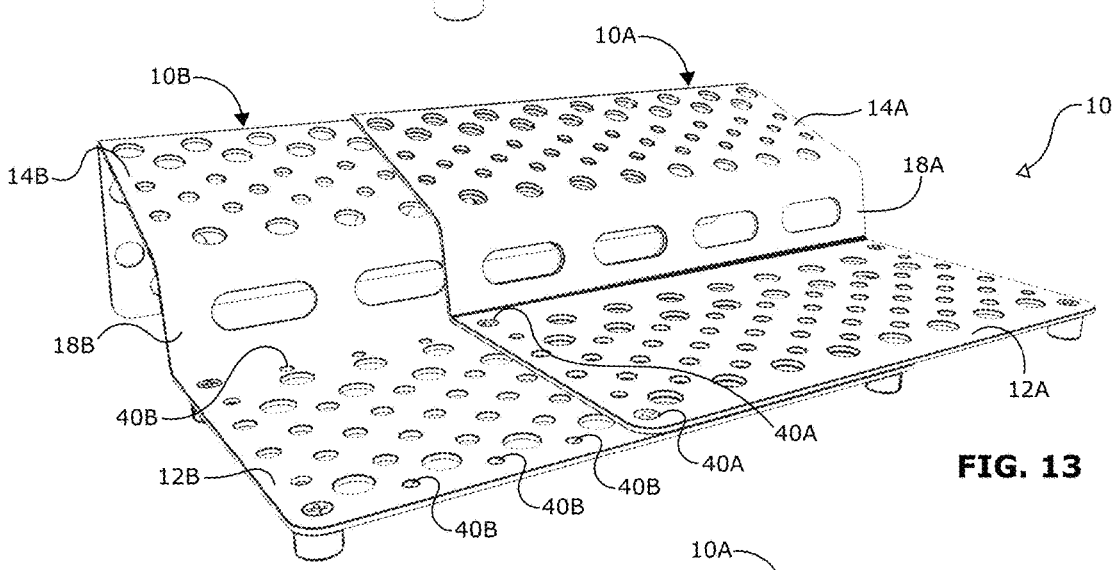
FIG. 13 is a front perspective view of an alternative embodiment of a guitar effects pedalboard partially extended.
Figure 14:
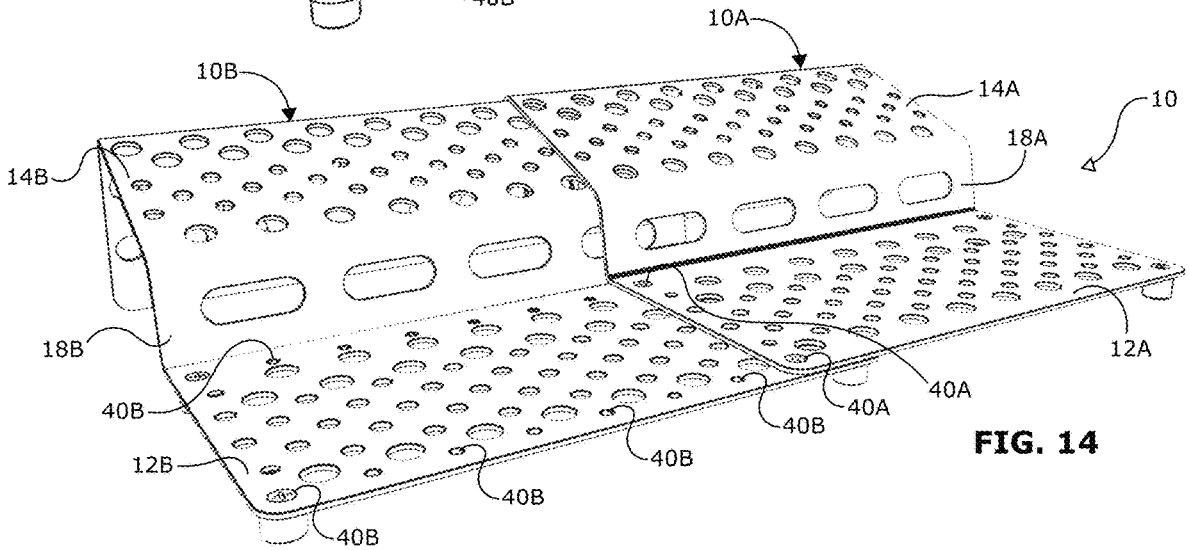
FIG. 14 is a front perspective view of an alternative embodiment of a guitar effects pedalboard fully extended.

FIGS. 9-11 and FIGS. 12-14 are front perspective views of modular guitar effects pedalboard systems 10 in various states of telescopic extension, with the embodiment of FIGS. 12-14 showing use without optional extension 20. To secure pedalboard 10A to pedalboard 10B in each state of extension, screw holes may be provided in each pedalboard that align coaxially with one another such that once the desired width of pedalboard system 10 and attachment area is achieved, the user may simply screw the pedalboards 10A and 10B together for a stable and secure fit. For example, as shown in the figures, screw holes 40B in pedalboard 10B may be provided in regularly spaced increments along the top and bottom of base level 12B, while a screw hole (and screw) 40A are provided at top and bottom of base level 12A of pedalboard 10A, enabling the attachment of pedalboard 10A to 10B via only two screws and at a user-desired width increment. As can be appreciated from these figures, modular pedalboard system 10 enables a highly customizable attachment area when pedalboard 10A and 10B are used in conjunction, thereby accommodating the flexible needs of musicians.

Figure 15:
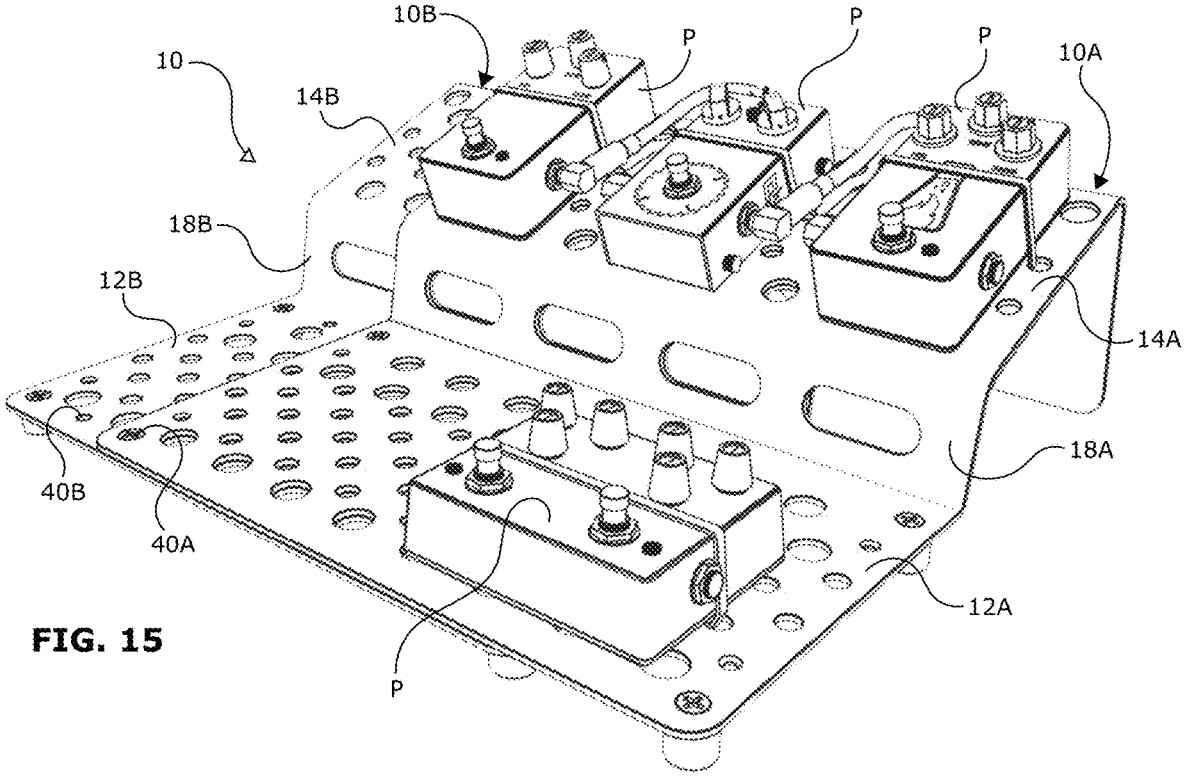
FIG. 15 is a front perspective view of a guitar effects pedalboard with guitar effects pedals secured to the board.
Figure 16:
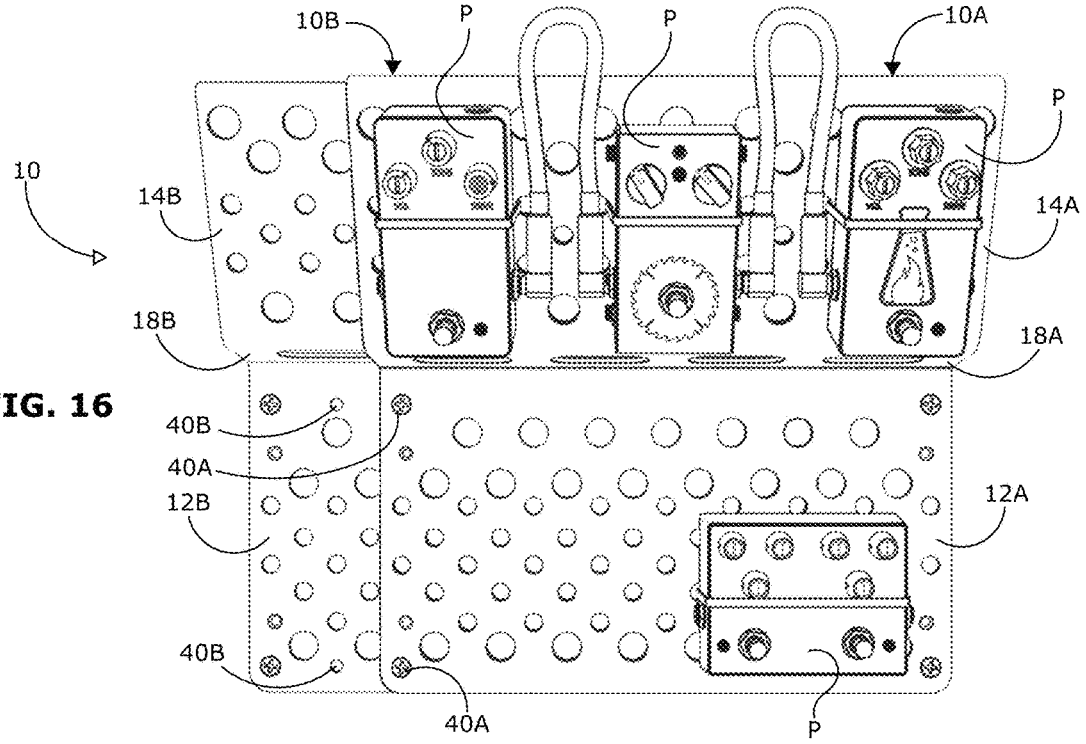
FIG. 16 is a top view of a guitar effects pedalboard with guitar effects pedals secured to the board.

FIGS. 15 and 16 are front perspective and top views of the modular guitar effects pedalboard system 10, showing an example of how guitar pedals P of various sizes and orientations may be attached to the surface of the pedalboard using cable ties (also known as zip ties), including to base level 12A and upper level 14A, for example.

Figure 17:
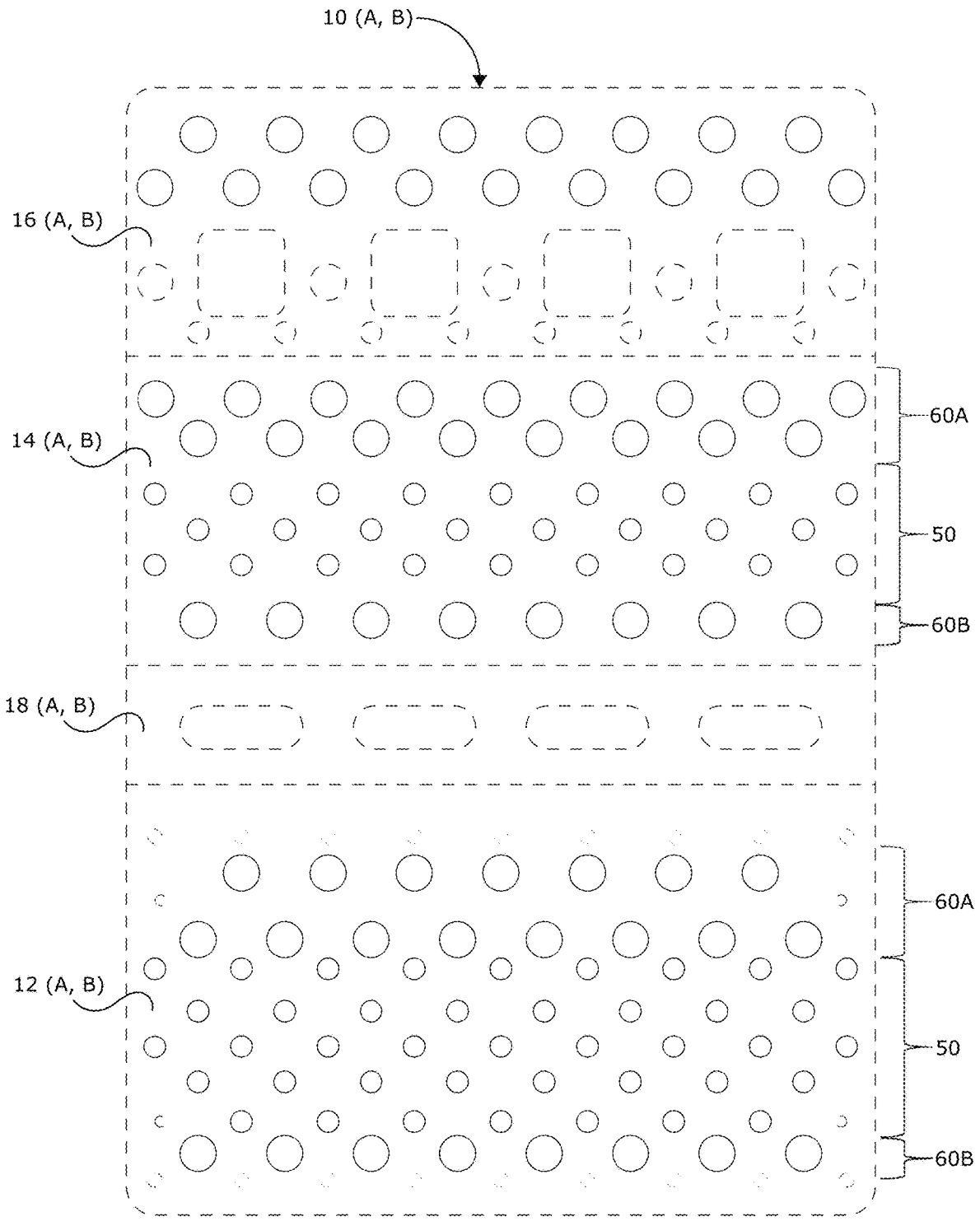
FIG. 17 is a planar view of a guitar effects pedalboard.

FIG. 17 is a planar view of a guitar effects pedalboard 10A or 10B showing separate and distinct pedal attachment regions, including a first attachment region 50 comprising a plurality of holes having a first diameter, and a second attachment region 60 (A, B) comprising a plurality of holes having a second diameter, which can also be seen in FIGS. 1-16. The second attachment region 60 (A, B) is shown having two sub-regions, 60A at the top and 60B at the bottom, flanking either side of the first attachment region 50, but it is contemplated that only one region 60A or 60B may also be utilized flexibly alone or in combination with the first attachment region 50. By providing two sub-regions 60A and 60B for the larger diameter holes, pedals may be more flexibly attached via cable ties to the board surface as described in more detail with reference to FIG. 22.

In the case of a pedalboard 10 (A, B) such as shown, these separate and distinct attachment regions 50 and 60 (A, B) may be present on both the base level 12 as well as the upper level 14 of the board, though other arrangements are contemplated. For example, base level 12 (A, B) may comprise only the first attachment region 50, while upper level 14 (A, B) may comprise only the second attachment region 60 (A, B), or vice versa. Alternatively, either base level 12 (A, B) or upper level 14 (A, B) may comprise a combination of the first and second attachment regions, while the other level only has one of the first and second attachment regions. Thus, multiple combinations and arrangements of the first attachment region 50 and second attachment region 60 (A, B) are possible to adjust the overall functionality and flexibility of use for the pedalboard 10 (A, B).

As can be appreciated in the figures, the plurality of holes in the first attachment region 50 have a first diameter that is smaller than the plurality of holes in the second attachment region 60 (A, B) having a second diameter. Accordingly, the first attachment region 50 is configured for use with both a cable-tie fastener as well as a hook and loop fastener. More specifically, the particular diameter and spacing of holes in the first attachment region 50 is optimized to improve the surface area available for adhesive backed hook and loop fasteners, such as Velcro, to sufficiently anchor, while also alternatively enabling the threading of a cable-tie through the holes to secure the attachment of pedals. Second attachment region 60 (A, B) having comparatively larger diameter holes is configured for use with cable-tie fasteners, since the larger holes provide more flexibility and a wider tolerance for threading the cable tie around varying sizes of pedals against the board surface. However, second attachment region 60 (A, B) is not configured for hook and loop fasteners due to the smaller surface area available for an adhesive backing, which may cause insufficient anchorage to the board.

Further shown is a third attachment region on the back side 16 (A, B) of pedalboard 10 (A, B), also with holes having a comparatively larger diameter than the first attachment region, to enable the flexible securement of a power source or power brick using cable ties. The power brick may either be secured on the outside surface of the back side 16 (A, B), or can be secured on the inside surface to be hidden underneath the upper level 14 (A, B).

Figure 18:
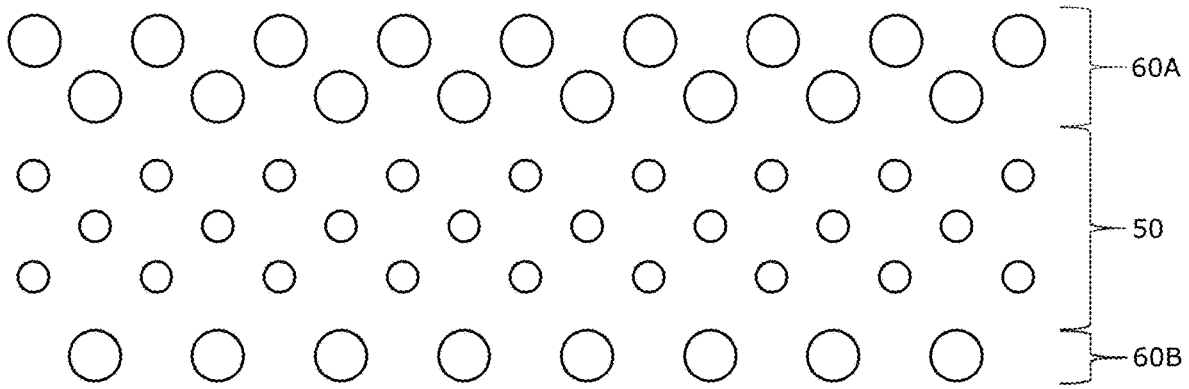
FIG. 18 is an isolated view of a region of the guitar effects pedalboard of FIG. 17.
Figure 19:
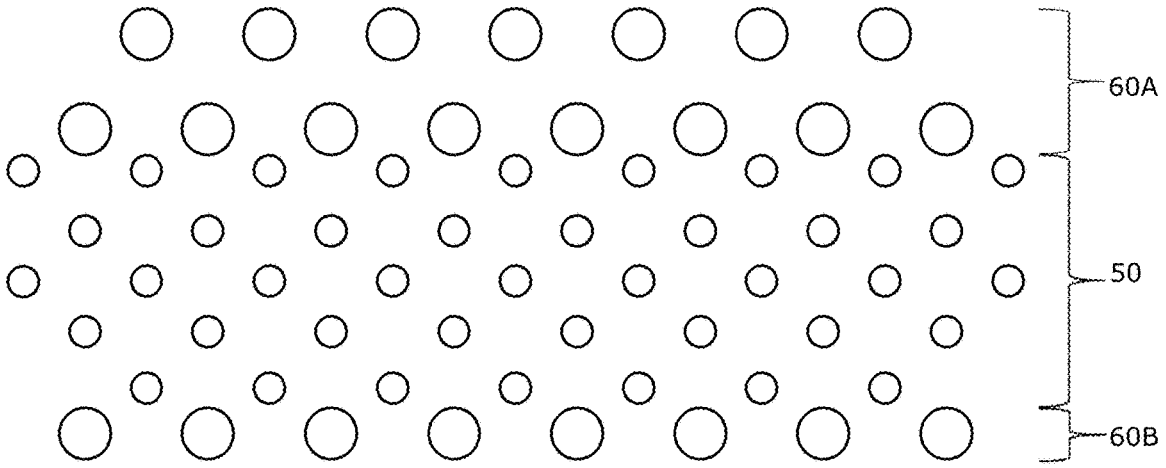
FIG. 19 is an isolated view of another region of the guitar effects pedalboard of FIG. 17.

FIG. 18 is an isolated view of FIG. 17, showing the hole pattern isolated from upper level 14 (A, B) of pedalboard 10 (A, B), and FIG. 19 is likewise an isolated view of FIG. 17 showing the hole pattern isolated from the base level 12 (A, B). As described in further detail below, the optimal diameters and particular spacing of the smaller and larger holes in each attachment region alone as well as in combination was surprisingly found to provide secure cable tie anchorage capability for almost any commercially available effects pedal having different sizes and orientations, as for example described with reference to TABLES 1 and 2 of the present disclosure.

Figure 20A:
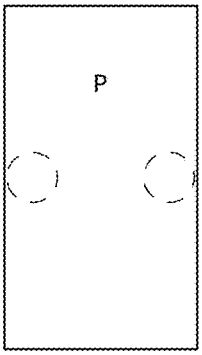
FIGS. 20A and 20B are simplified views of a guitar effects pedal and hole relationship on a guitar effects pedalboard.
Figure 20B:
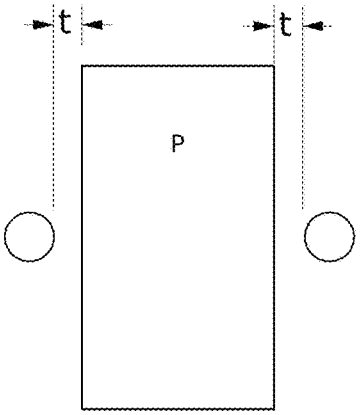
Figure 21A:
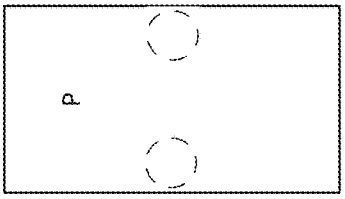
FIGS. 21A and 21B are another simplified view of a guitar effects pedal and hole relationship on a guitar effects pedalboard.
Figure 21B:
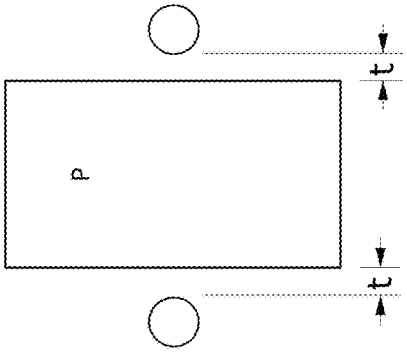

FIGS. 20A, 20B, 21A and 21B are simplified views of a guitar effects pedal P and hole relationship on the effects pedalboard 10 (A, B). Based on the testing of actual guitar pedals, it was determined that an optimal anchorage using cable ties was achievable when the pedal P was positioned such that the very outer edge of each hole was aligned with or just inside the outside edges of the pedal P, in either vertical or horizontal orientation, such as depicted in FIGS. 20A and 21A, or when the inside edge of each hole was within a maximum tolerance t of 0.350 inches from the outside edges of the pedal P, such as depicted in FIGS. 20B and 21B. When within this tolerance range, the pedal P was less likely to slide around under the cable tie, and was therefore more firmly and securely anchored in place on the board surface.

Figure 22:
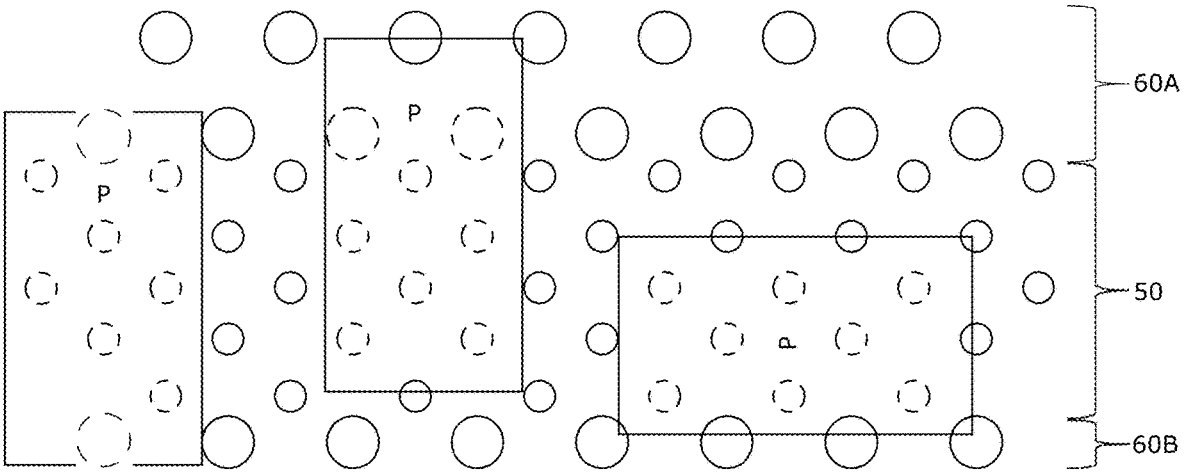
FIG. 22 is a simplified view of multiple guitar effects pedals in relation to holes of a guitar effects pedalboard.
Figure 23:
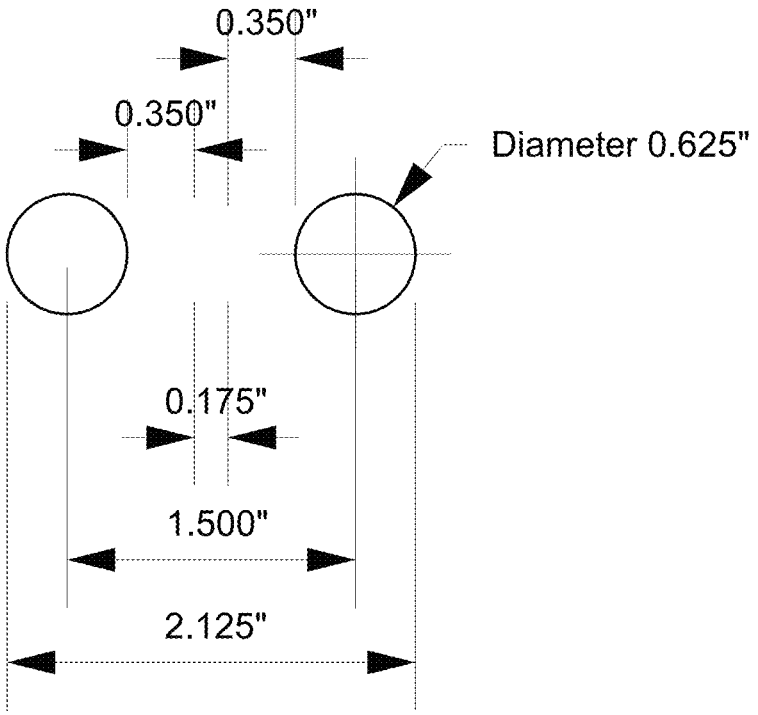
FIG. 23 shows example dimensions for two horizontally adjacent holes on a guitar effects pedalboard.
Figure 24:
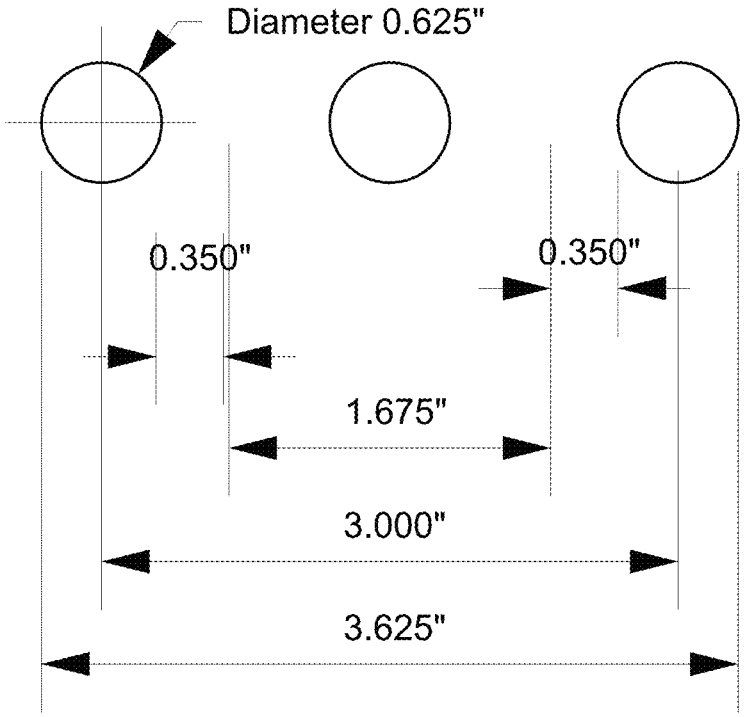
FIG. 24 shows example dimensions for three horizontally adjacent holes on a guitar effects pedalboard.
Figure 25:
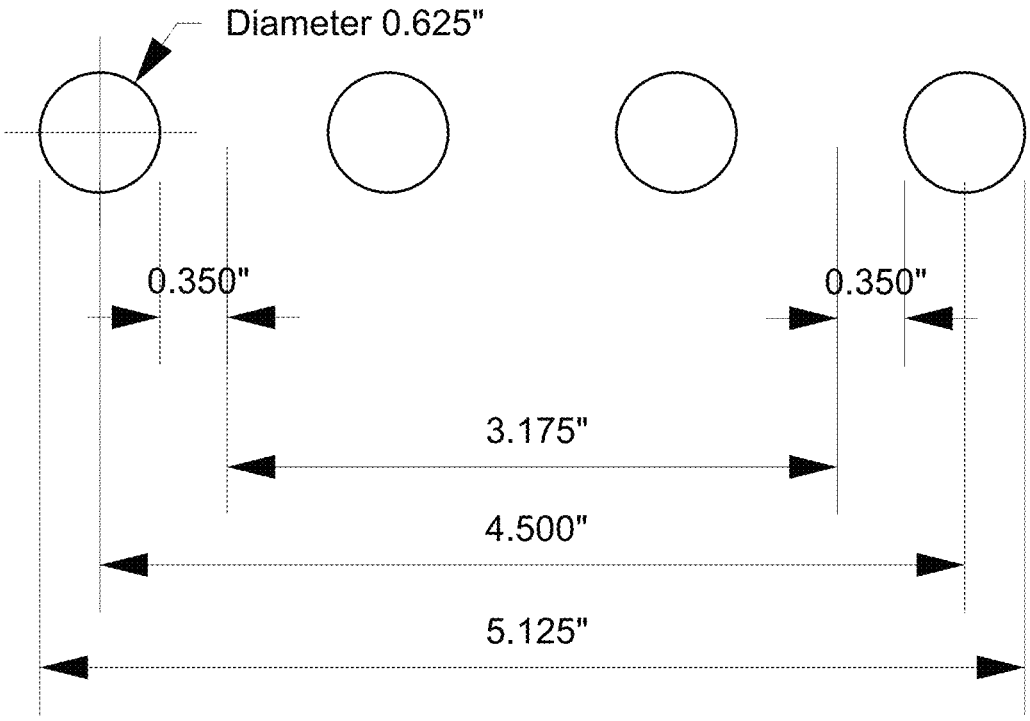
FIG. 25 shows example dimensions for four horizontally adjacent holes on a guitar effects pedalboard.
Figure 26:
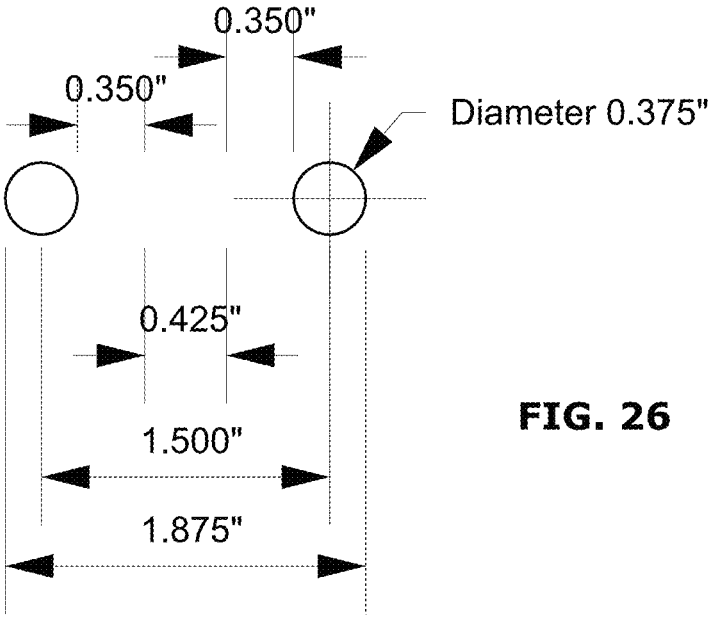
FIG. 26 shows another example of dimensions for two horizontally adjacent holes on a guitar effects pedalboard.
Figure 27:
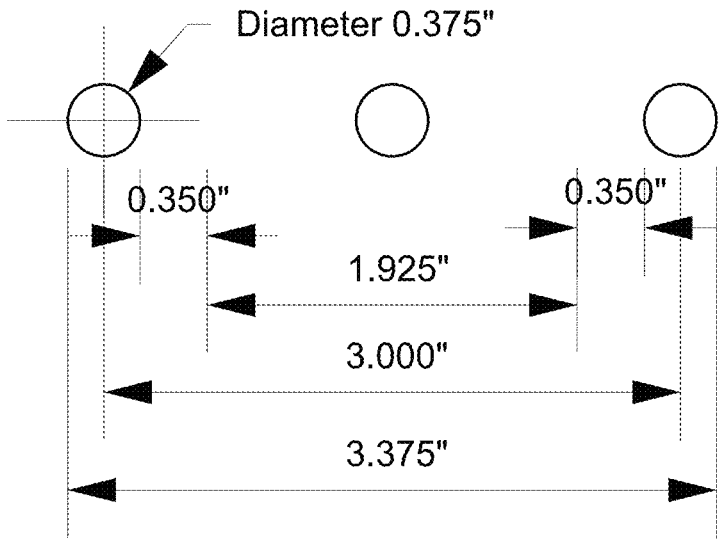
FIG. 27 shows another example of dimensions for three horizontally adjacent holes on a guitar effects pedalboard.
Figure 28:
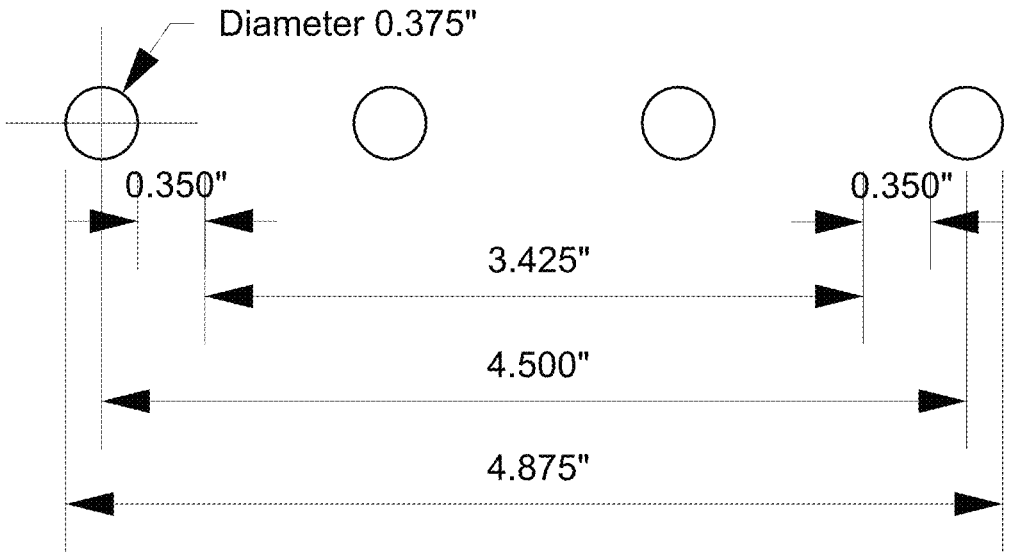
FIG. 28 shows another example of dimensions for four horizontally adjacent holes on a guitar effects pedalboard.
Figure 29:
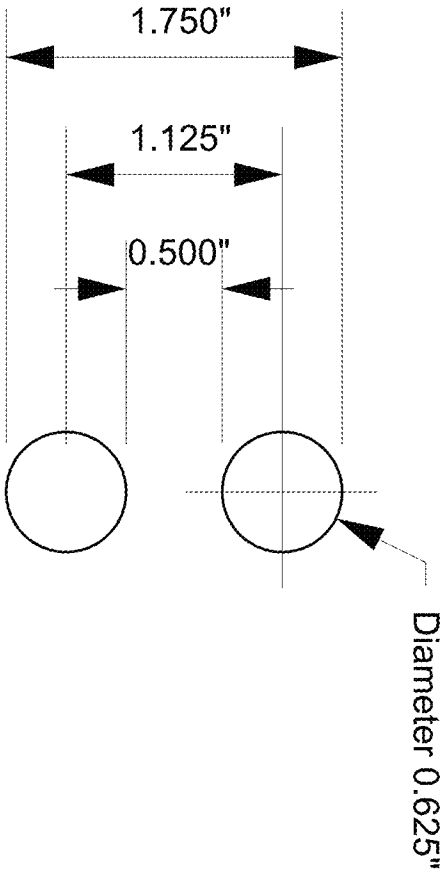
FIG. 29 shows example dimensions for two vertically adjacent holes on a guitar effects pedalboard.
Figure 30:
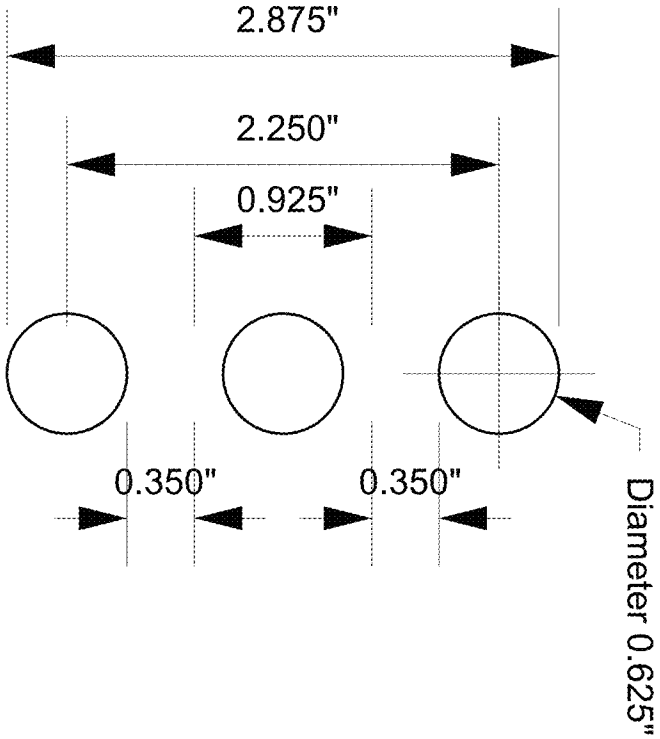
FIG. 30 shows example dimensions for three vertically adjacent holes on a guitar effects pedalboard.
Figure 31:
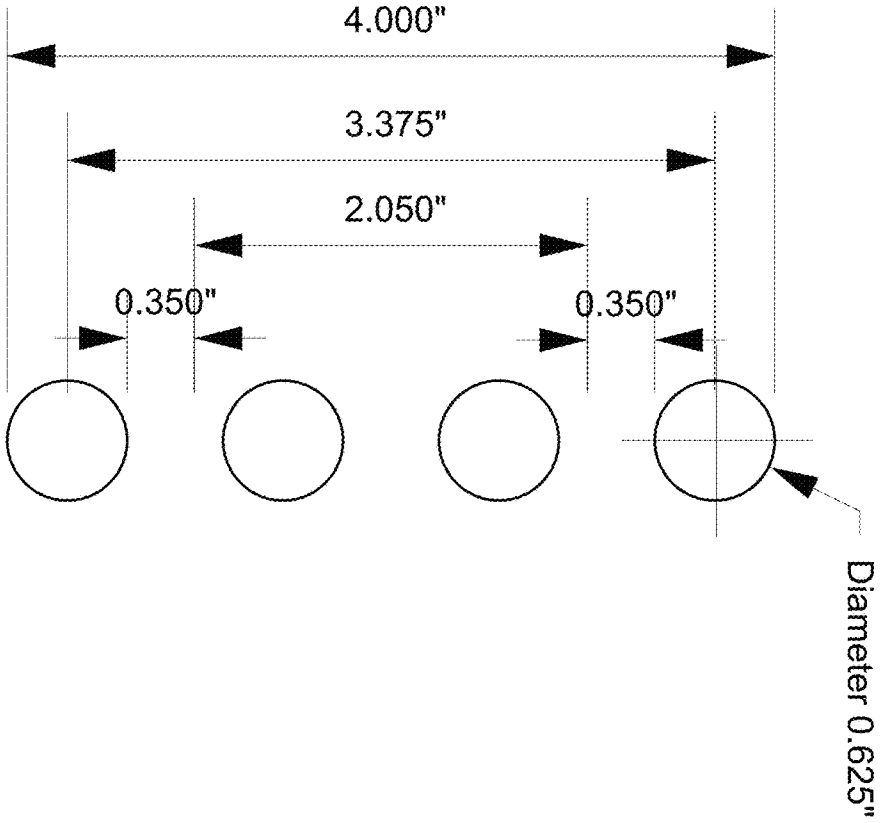
FIG. 31 shows example dimensions for four vertically adjacent holes on a guitar effects pedalboard.
Figure 32:
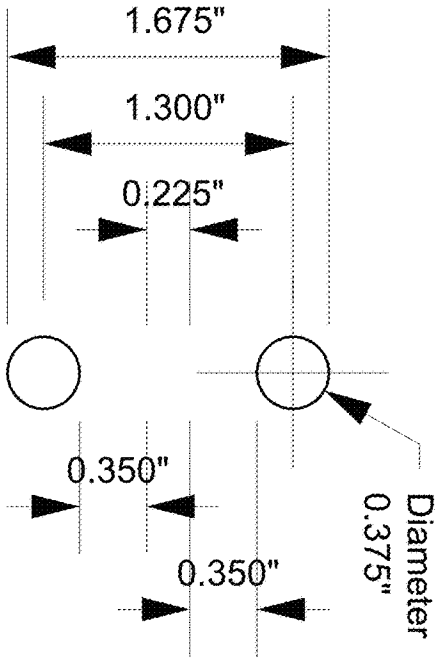
FIG. 32 shows another example of dimensions for two vertically adjacent holes on a guitar effects pedalboard.
Figure 33:
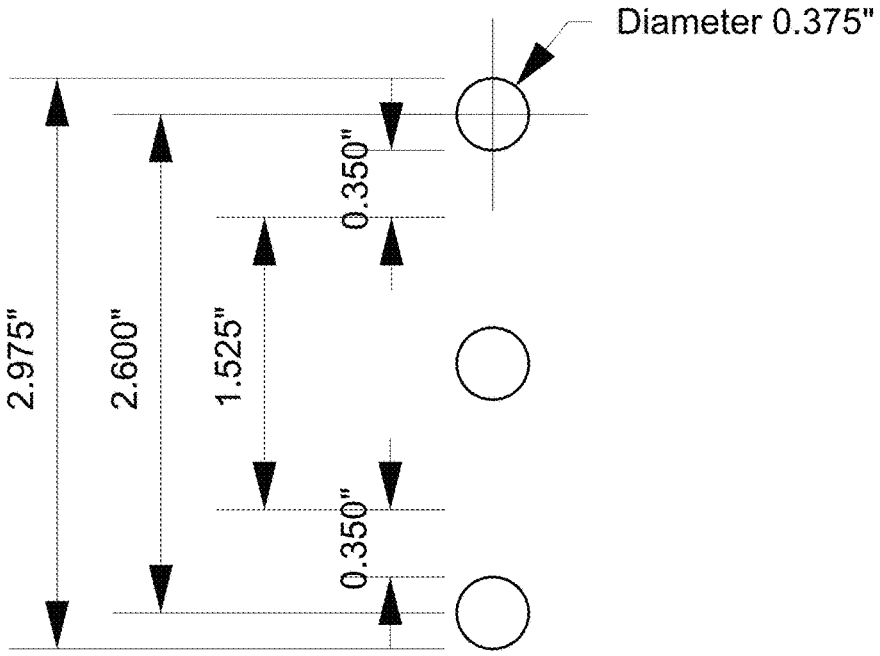
FIG. 33 shows another example of dimensions for three vertically adjacent holes on a guitar effects pedalboard.
Figure 34:
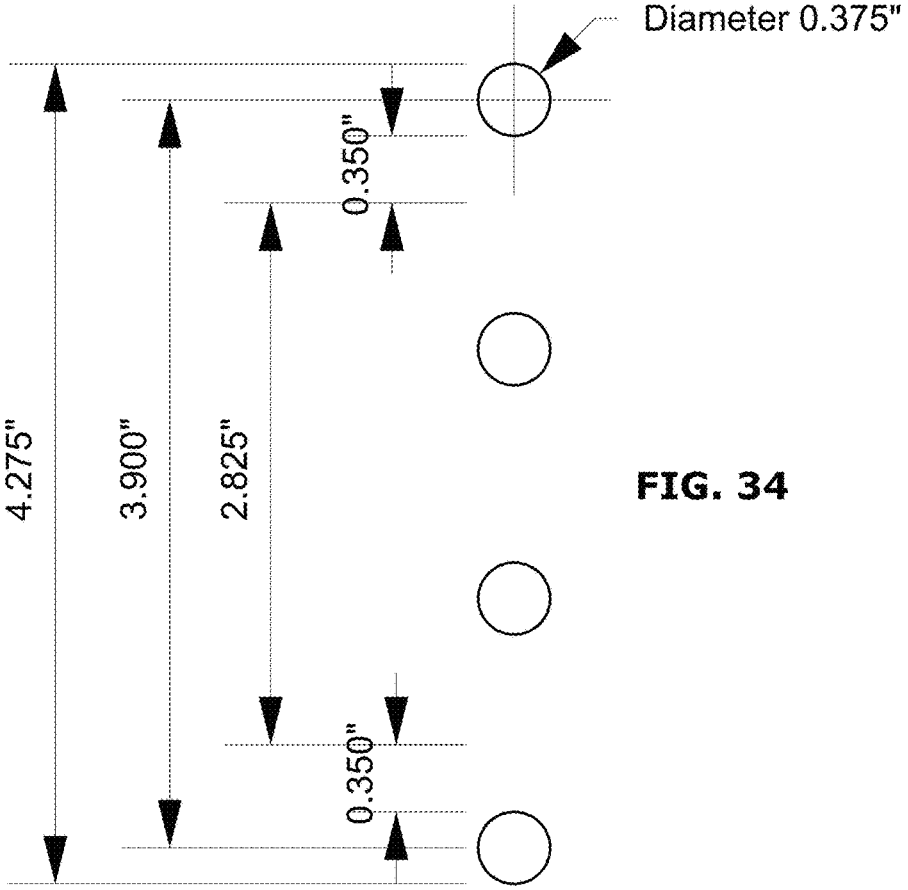
FIG. 34 shows another example of dimensions for four vertically adjacent holes on a guitar effects pedalboard.

FIG. 22 is an isolated view of FIG. 17 showing the hole pattern isolated from base level 12 (A, B), as well as examples of how guitar pedals P may flexibly overlay holes from both the first attachment region 50 as well as the second attachment region 60 (A, B). Further, by separating the second attachment region 60 (A, B) into a first sub-region 60A and second sub-region 60B flanking either side of the first attachment region 50, it can be seen that pedal positioning and anchoring is more flexibly enabled through combinations of large diameter and small diameter holes. As stated previously, larger diameter holes allow for greater internal tolerance in cable tying the pedal, while smaller diameter holes having less internal tolerance require more precise pedal positioning and placement within a specified tolerance from the edge of the hole (as described with reference to FIGS. 20A, 20B, 21A and 21B). Pedalboards which only provide a uniform hole size and pattern across the entire surface therefore suffer from decreased flexibility in cable tying a combination of pedals having various sizes and orientations, and are furthermore not optimized for both cable tie as well as hook and loop fasteners simultaneously. A suitable size for the smaller holes, such as in the first attachment region 50, may comprise a diameter of about 0.25 inches to about 0.45 inches, more optimally about 0.375 inches, while the larger holes in the second attachment region 60 (A, B) may comprise a diameter of about 0.50 inches to about 0.75 inches, more optimally about 0.625 inches.

FIGS. 23-34 provide examples of dimensions configured for optimal cable tie attachment of pedals using the comparatively large and small hole sizes described previously in the first attachment region 50 and second attachment region 60 (A, B), including the optimal spacing between holes of each type. These dimensions were based on an optimal inside tolerance of 0.350 inches as described with reference to FIGS. 20A, 20B, 21A and 21B.

TABLE 1 is an organized representation of the dimensions provided in FIGS. 23-34 as well as extrapolated dimensions, and further provides the compatible pedal dimensions (e.g., size in width or depth direction) and orientation (e.g., horizontal versus vertical) for the large and small hole diameters, including the number of holes needing to be spanned for each pedal dimension. As described previously, the large hole diameter may correspond to the second attachment zone 60 (A, B), while the smaller hole diameter may correspond to the first attachment zone 50.

TABLE 1

| Hole Size | Hole & Pedal Orientation | Number of Holes Spanned | Outermost Holes: Center to Center Distance (inches) | Compatible Pedal Dimension (inches) | Corre-sponding Figure of Patent |
|---|---|---|---|---|---|
| Large (0.625 inch diameter) | Horizontal (Width) | 2 | 1.500 | 0.175-2.125 | FIG. 23 |
| | | 3 | 3.000 | 1.675-3.625 | FIG. 24 |
| | | 4 | 4.500 | 3.175-5.125 | FIG. 25 |
| | | 5 | 6.000 | 4.675-6.625 | N/A |
| | | 6 | 7.500 | 6.175-8.125 | N/A |
| | | 7 | 9.000 | 7.675-9.625 | N/A |
| | | 8 | 10.500 | 9.175-11.125 | N/A |
| | Vertical (Depth) | 2 | 1.125 | 0.500-1.750 | FIG. 29 |
| | | 3 | 2.250 | 0.925-2.875 | FIG. 30 |
| | | 4 | 3.375 | 2.050-4.000 | FIG. 31 |
| | | 5 | 4.500 | 3.175-5.125 | N/A |
| | | 6 | 5.625 | 4.300-6.250 | N/A |
| | | 7 | 6.750 | 5.425-7.375 | N/A |
| | | 8 | 7.875 | 6.550-8.500 | N/A |

TABLE 1-continued

| Hole Size | Hole & Pedal Orientation | Number of Holes Spanned | Outermost Holes: Center to Center Distance (inches) | Compatible Pedal Dimension (inches) | Corre-sponding Figure of Patent |
|---|---|---|---|---|---|
| Small (0.375 inch diameter) | Horizontal (Width) | 2 | 1.500 | 0.425-1.875 | FIG. 26 |
| | | 3 | 3.000 | 1.925-3.375 | FIG. 27 |
| | | 4 | 4.500 | 3.425-4.875 | FIG. 28 |
| | | 5 | 6.000 | 4.925-6.375 | N/A |
| | | 6 | 7.500 | 6.425-7.875 | N/A |
| | | 7 | 9.000 | 7.925-9.375 | N/A |
| | | 8 | 10.500 | 9.425-10.875 | N/A |
| | Vertical (Depth) | 2 | 1.300 | 0.225-1.675 | FIG. 32 |
| | | 3 | 2.600 | 1.525-2.975 | FIG. 33 |
| | | 4 | 3.900 | 2.825-4.275 | FIG. 34 |
| | | 5 | 5.200 | 4.125-5.575 | N/A |
| | | 6 | 6.500 | 5.425-6.875 | N/A |
| | | 7 | 7.800 | 6.725-8.175 | N/A |
| | | 8 | 9.100 | 8.025-9.475 | N/A |

It was surprisingly found that when the large and small holes were spaced according to the dimensions of TABLE 1 as well as represented in FIGS. 23-34, essentially every commercially available pedal size and orientation could be accommodated by a single pedalboard 10 (A, B) alone, or as a modular pedalboard system 10 to further expand the usable area. This was in part accomplished by optimizing, through much trial and error, the horizontal and vertical center-to-center distance based on the chosen small and large hole diameters and maximum internal tolerance to enable a wide range of pedal sizes and orientations to work in practice, such as described further with reference to TABLES 2A-2D of the present disclosure. Suitable horizontal center-to-center spacing between each adjacent smaller diameter hole was between about 1.35 inches to about 1.65 inches, more preferably 1.5 inches. Suitable vertical center-to-center spacing between each adjacent smaller diameter hole was between about 0.9 inches to about 1.3 inches, more preferably 1.3 inches. Suitable horizontal center-to-center spacing between each adjacent larger diameter hole was between about 1.35 inches to about 1.65 inches, more preferably 1.5 inches. Suitable vertical center-to-center spacing between each adjacent larger diameter hole was between about 0.9 inches to about 1.3 inches, more preferably 1.125 inches.

Although TABLE 1 only includes a maximum of 8 holes spanned, this is not limiting where the distance remains equidistant between each adjacent hole. In such case, the center-to-center distance of two adjacent holes in either the horizontal or vertical direction provides the smallest unit by which the smallest and largest dimensions of the pedal (width-wise or depth-wise) may be accommodated in larger and larger increments with each hole added, factoring in the internal tolerance and hole diameter upon which the measurements are based.

TABLES 2A-2D show examples of commercially available pedals having a wide variety of sizes and orientations, and their compatible securement over the hole diameters and spacings described with reference to TABLE 1 and FIGS. 23-34.

TABLE 2A shows pedal horizontal (width) compatibility for the larger holes having a 0.625 inch diameter and 1.5 inch center-to-center spacing between two adjacent holes. As can be seen, almost all of the tested commercial pedals were able to fit within a 4 hole span, with only a few larger pedals requiring additional space. Nonetheless, all the pedals could be accommodated using a single pedalboard 10 (A, B) or modular pedalboard system 10.

TABLE 2A

| Brand | Model | Width (inches) | Depth (inches) | 2 hole spacing: 0.500" to 1.750" | 3 hole spacing: 0.925" to 2.875" | 4 hole spacing: 2.050" to 4.000" | Other hole spacing |
|---|---|---|---|---|---|---|---|
| Walrus audio | Janus | 8.375 | 4.75 | | | | 7 holes, Yes |
| Walrus audio | 385 | 2.625 | 4.8125 | | Yes | | |
| Fulltone | Clyde Deluxe Wah | 3.5 | 10 | | Yes | Yes | |
| Fulltone | Deja Vibe | 5.75 | 4 | | | | 5 holes, Yes |
| Fulltone | Supa Trem | 6 | 3.125 | | | | 6 holes, Yes |
| Fulltone | 70 | 2.375 | 4.25 | | Yes | | |
| Fulltone | Full Drive 3 | 4.75 | 4 | | | Yes | |
| Fulltone | OCD | 2.375 | 4.25 | | Yes | | |
| Zvex | Fuzz Factory | 2.375 | 4.375 | | Yes | | |
| Zvex | Box of Rock | 2.375 | 4.375 | | Yes | | |
| Catalinbread | RAH | 2.375 | 4.375 | | Yes | | |
| Catalinbread | Zero point | 2.375 | 4.375 | | Yes | | |
| Catalinbread | Belle Epoch | 2.375 | 4.375 | | Yes | | |
| Catalinbread | Echorec | 2.375 | 4.375 | | Yes | | |
| JHS | Charlie Brown | 2.625 | 4.875 | | Yes | | |
| JHS | Supro | 2.625 | 4.875 | | Yes | | |
| EarthQuaker Devices | Organizer | 2.625 | 4.75 | | Yes | | |
| Henrietta Engineering | H-bomb drive | 2.625 | 4.75 | | Yes | | |
| Seymour Duncan | Catalina | 3.5 | 4.75 | | Yes | Yes | |
| Seymour Duncan | 805 | 2.625 | 5 | | Yes | | |
| Seymour Duncan | Forza | 2.625 | 5 | | Yes | | |
| Seymour Duncan | Vapor Trail | 2.625 | 5 | | Yes | | |
| Radial | Twin city bones | 3.5 | 4.375 | | Yes | Yes | |
| Frantone | Peach Fuzz | 4.625 | 3.625 | | | Yes | |
| Maxon | AD999 | 4.375 | 6 | | | Yes | |
| Xotic | SL Drive | 1.5 | 3.625 | Yes | | | |

TABLE 2B shows pedal vertical (depth) compatibility for the larger holes having a 0.625 inch diameter and 1.125 inch center-to-center spacing between two adjacent holes. As can be seen, all of the tested commercial pedals were able to fit within a 4 to 6 hole span and could be accommodated using a single pedalboard 10 (A, B) or modular pedalboard system 10.

TABLE 2B

| Brand | Model | Width (inches) | Depth (inches) | 2 hole spacing: 0.175" to 2.125" | 3 hole spacing: 1.675" to 3.625" | 4 hole spacing: 3.175" to 5.125" | Other hole spacing |
|---|---|---|---|---|---|---|---|
| Walrus audio | Janus | 8.375 | 4.75 | | | | 5 holes, Yes |
| Walrus audio | 385 | 2.625 | 4.8125 | | | | 5 holes, Yes |
| Fulltone | Clyde Deluxe Wah | 3.5 | 10 | | | | N/A |
| Fulltone | Deja Vibe | 5.75 | 4 | | | Yes | |
| Fulltone | Supa Trem | 6 | 3.125 | | | Yes | |
| Fulltone | 70 | 2.375 | 4.25 | | | | 5 holes, Yes |
| Fulltone | Full Drive 3 | 4.75 | 4 | | | Yes | |
| Fulltone | OCD | 2.375 | 4.25 | | | | 5 holes, Yes |
| Zvex | Fuzz Factory | 2.375 | 4.375 | | | | 5 holes, Yes |
| Zvex | Box of Rock | 2.375 | 4.375 | | | | 5 holes, Yes |
| Catalinbread | RAH | 2.375 | 4.375 | | | | 5 holes, Yes |
| Catalinbread | Zero point | 2.375 | 4.375 | | | | 5 holes, Yes |
| Catalinbread | Belle Epoch | 2.375 | 4.375 | | | | 5 holes, Yes |
| Catalinbread | Echorec | 2.375 | 4.375 | | | | 5 holes, Yes |
| JHS | Charlie Brown | 2.625 | 4.875 | | | | 5 holes, Yes |
| JHS | Supro | 2.625 | 4.875 | | | | 5 holes, Yes |
| EarthQuaker Devices | Organizer | 2.625 | 4.75 | | | | 5 holes, Yes |
| Henrietta Engineering | H-bomb drive | 2.625 | 4.75 | | | | 5 holes, Yes |

TABLE 2B-continued

| Brand | Model | Width (inches) | Depth (inches) | 2 hole spacing: 0.175" to 2.125" | 3 hole spacing: 1.675" to 3.625" | 4 hole spacing: 3.175" to 5.125" | Other hole spacing |
|---|---|---|---|---|---|---|---|
| Seymour Duncan | Catalina | 3.5 | 4.75 | | | | 5 holes, Yes |
| Seymour Duncan | 805 | 2.625 | 5 | | | | 5 holes, Yes |
| Seymour Duncan | Forza | 2.625 | 5 | | | | 5 holes, Yes |
| Seymour Duncan | Vapor Trail | 2.625 | | | | | 5 holes, Yes |
| Radial | Twin city bones | 3.5 | 4.375 | | | | 5 holes, Yes |
| Frantone | Peach Fuzz | 4.625 | 3.625 | | | Yes | |
| Maxon | AD999 | 4.375 | 6 | | | | 6 holes, Yes |
| Xotic | SL Drive | 1.5 | 3.625 | | | Yes | |

TABLE 2C shows pedal horizontal (width) compatibility for the smaller holes having a 0.375 inch diameter and 1.5 inch center-to-center spacing between two adjacent holes. As can be seen, almost all of the tested commercial pedals were able to fit within a 4 hole span, with only a few larger pedals requiring additional space. Nonetheless, all the pedals could be accommodated using a single pedalboard 10 (A, B) or modular pedalboard system 10.

TABLE 2C

| Brand | Model | Width (inches) | Depth (inches) | 2 hole spacing: 0.425" to 1.875" | 3 hole spacing: 1.925" to 3.375" | 4 hole spacing: 3.425" to 4.875" | Other hole spacing |
|---|---|---|---|---|---|---|---|
| Walrus audio | Janus | 8.375 | 4.75 | | | | 7 holes, Yes |
| Walrus audio | 385 | 2.625 | 4.8125 | | Yes | | |
| Fulltone | Clyde Deluxe Wah | 3.5 | 10 | | | Yes | |
| Fulltone | Deja Vibe | 5.75 | 4 | | | | 5 holes, Yes |
| Fulltone | Supa Trem | 6 | 3.125 | | | | 5 holes, Yes |
| Fulltone | 70 | 2.375 | 4.25 | | Yes | | |
| Fulltone | Full Drive 3 | 4.75 | 4 | | | Yes | |
| Fulltone | OCD | 2.375 | 4.25 | | Yes | | |
| Zvex | Fuzz Factory | 2.375 | 4.375 | | Yes | | |
| Zvex | Box of Rock | 2.375 | 4.375 | | Yes | | |
| Catalinbread | RAH | 2.375 | 4.375 | | Yes | | |
| Catalinbread | Zero point | 2.375 | 4.375 | | Yes | | |
| Catalinbread | Belle Epoch | 2.375 | 4.375 | | Yes | | |
| Catalinbread | Echorec | 2.375 | 4.375 | | Yes | | |
| JHS | Charlie Brown | 2.625 | 4.875 | | Yes | | |
| JHS | Supro | 2.625 | 4.875 | | Yes | | |
| EarthQuaker Devices | Organizer | 2.625 | 4.75 | | Yes | | |
| Henrietta Engineering | H-bomb drive | 2.625 | 4.75 | | Yes | | |
| Seymour Duncan | Catalina | 3.5 | 4.75 | | | Yes | |
| Seymour Duncan | 805 | 2.625 | 5 | | Yes | | |
| Seymour Duncan | Forza | 2.625 | 5 | | Yes | | |
| Seymour Duncan | Vapor Trail | 2.625 | | | Yes | | |
| Radial | Twin city bones | 3.5 | 4.375 | | | Yes | |
| Frantone | Peach Fuzz | 4.625 | 3.625 | | | Yes | |
| Maxon | AD999 | 4.375 | 6 | | | Yes | |
| Xotic | SL Drive | 1.5 | 3.625 | Yes | | | |

TABLE 2D shows pedal vertical (depth) compatibility for the smaller holes having a 0.375 inch diameter and 1.300 inch center-to-center spacing between two adjacent holes. As can be seen, all of the tested commercial pedals were able to fit within a 4 to 6 hole span and could be accommodated using a single pedalboard 10 (A, B) or modular pedalboard system 10.

TABLE 2D

| Brand | Model | Width (inches) | Depth (inches) | 2 hole spacing: 0.225" to 1.675" | 3 hole spacing: 1.525" to 2.975" | 4 hole spacing: 2.825" to 4.275" | Other hole spacing |
|---|---|---|---|---|---|---|---|
| Walrus audio | Janus | 8.375 | 4.75 | | | | 5 holes, Yes |
| Walrus audio | 385 | 2.625 | 4.8125 | | | | 5 holes, Yes |
| Fulltone | Clyde Deluxe Wah | 3.5 | 10 | | | | N/A |
| Fulltone | Deja Vibe | 5.75 | 4 | | | Yes | |
| Fulltone | Supa Trem | 6 | 3.125 | | | Yes | |
| Fulltone | 70 | 2.375 | 4.25 | | | Yes | |
| Fulltone | Full Drive 3 | 4.75 | 4 | | | Yes | |
| Fulltone | OCD | 2.375 | 4.25 | | | Yes | |
| Zvex | Fuzz Factory | 2.375 | 4.375 | | | | 5 holes, Yes |
| Zvex | Box of Rock | 2.375 | 4.375 | | | | 5 holes, Yes |
| Catalinbread | RAH | 2.375 | 4.375 | | | | 5 holes, Yes |
| Catalinbread | Zero point | 2.375 | 4.375 | | | | 5 holes, Yes |
| Catalinbread | Belle Epoch | 2.375 | 4.375 | | | | 5 holes, Yes |
| Catalinbread | Echorec | 2.375 | 4.375 | | | | 5 holes, Yes |
| JHS | Charlie Brown | 2.625 | 4.875 | | | | 5 holes, Yes |
| JHS | Supro | 2.625 | 4.875 | | | | 5 holes, Yes |
| EarthQuaker Devices | Organizer | 2.625 | 4.75 | | | | 5 holes, Yes |
| Henrietta Engineering | H-bomb drive | 2.625 | 4.75 | | | | 5 holes, Yes |
| Seymour Duncan | Catalina | 3.5 | 4.75 | | | | 5 holes, Yes |
| Seymour Duncan | 805 | 2.625 | 5 | | | | 5 holes, Yes |
| Seymour Duncan | Forza | 2.625 | | | | | 5 holes, Yes |
| Seymour Duncan | Vapor Trail | 2.625 | | | | | 5 holes, Yes |
| Radial | Twin city bones | 3.5 | 4.375 | | | | 5 holes, Yes |
| Frantone | Peach Fuzz | 4.625 | 3.625 | | | Yes | |
| Maxon | AD999 | 4.375 | 6 | | | | 6 holes, Yes |
| Xotic | SL Drive | 1.5 | 3.625 | | | Yes | |

Accordingly, pedalboard 10 (A, B) provides a design and functionality uniquely capable of accommodating essentially any commercially available guitar effects pedal having a wide variety of sizes and orientations, as well as providing ample flexibility for the user to secure multiple combinations of such pedals onto the same surface, including the option of increasing the available area of attachment through modularity of the system 10. Further, pedalboard 10 (A, B) is uniquely able to accommodate simultaneous cable-tie as well as hook and loop attachment of pedals to its surface, providing even more flexibility for the user. The present disclosure further enables the improvement of any pedalboard's functionality, regardless of overall dimension and design, through the selection of optimal hole diameters and spacings as well as the use of multiple attachment regions in various configurations, as was described herein.

While the invention has been described with reference to an exemplary examples and embodiment(s), it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) and examples herein disclosed, but that the invention will include all embodiments falling within the scope of the appended claims.

The invention claimed is:

1. A guitar effects pedalboard comprising:

a first attachment region and a second attachment region, the first attachment region comprising a plurality of holes having a first diameter, and the second attachment region comprising a plurality of holes having a second diameter, wherein the first diameter is smaller than the second diameter;

a base level and an upper level, wherein the base level is formed integrally with the upper level; and wherein the pedalboard is configured to overlay a second pedalboard of the same design but smaller dimensions in a telescoping relationship.

2. The guitar effects pedalboard of claim 1, further comprising wherein the first attachment region is suitable for use with both a cable-tie fastener and a hook and loop fastener.

3. The guitar effects pedalboard of claim 1, further comprising wherein the second attachment region is suitable for use with a cable-tie fastener but not for a hook and loop fastener.

4. The guitar effects pedalboard of claim 1, further comprising wherein the second attachment region is divided into two subregions that flank either side of the first attachment region.

5. The guitar effects pedalboard of claim 1, further comprising wherein the horizontal center-to-center spacing between each adjacent hole in the first attachment region is between about 1.35 inches to about 1.65 inches.

6. The guitar effects pedalboard of claim 1, further comprising wherein the horizontal center-to-center spacing between each adjacent hole in the second attachment region is between about 1.35 inches to about 1.65 inches.

7. The guitar effects pedalboard of claim 1, further comprising wherein the vertical center-to-center spacing between each adjacent hole in the first attachment region is about 0.9 inches to about 1.3 inches.

8. The guitar effects pedalboard of claim 1, further comprising wherein the vertical center-to-center spacing between each adjacent hole in the second attachment region is about 0.9 inches to about 1.3 inches.

9. The guitar effects pedalboard of claim 1, further comprising wherein the diameter of the plurality of holes in the first attachment region is about 0.25 inches to about 0.45 inches.

10. The guitar effects pedalboard of claim 1, further comprising wherein the diameter of the plurality of holes in the second attachment region is about 0.50 inches to about 0.75 inches.

11. The guitar effects pedalboard of claim 1, further comprising wherein the plurality of holes in the first attachment region is suitable to secure pedals having a width of about 0.425 inches to about 10.875 inches.

12. The guitar effects pedalboard of claim 1, further comprising wherein the plurality of holes in the second attachment region is suitable to secure pedals having a width of about 0.175 inches to about 11.125 inches.

13. The guitar effects pedalboard of claim 1, further comprising wherein the plurality of holes in the first attachment region is suitable to secure pedals having a depth of about 0.225 inches to about 9.475 inches.

14. The guitar effects pedalboard of claim 1, further comprising wherein the plurality of holes in the second attachment region is suitable to secure pedals having a depth of about 0.500 inches to about 8.500 inches.

15. The guitar effects pedalboard of claim 1, further comprising wherein the plurality of holes in the first attachment region and second attachment region are configured to align coaxially with a corresponding plurality of holes in a first attachment region and a second attachment region of the second pedalboard at multiple telescoping positions.

16. The guitar effects pedalboard of claim 1, further comprising wherein both the base level and the upper level comprise the first attachment region and the second attachment region.

17. A guitar effects pedalboard comprising:

a first attachment region and a second attachment region, the first attachment region comprising a plurality of holes having a first diameter, and the second attachment region comprising a plurality of holes having a second diameter, wherein the first diameter is smaller than the second diameter;

a base level and an upper level, wherein the base level is formed integrally with the upper level; and a back-side having a plurality of holes suitable for cable tie attachment of a power supply.

18. A guitar effects pedalboard comprising:

a first attachment region and a second attachment region, the first attachment region comprising a plurality of holes having a first diameter, and the second attachment region comprising a plurality of holes having a second diameter, wherein the first diameter is smaller than the second diameter;

a base level and an upper level, wherein the base level is formed integrally with the upper level; and a riser section between the base level and upper level and having a plurality of holes suitable for organizing the routing of power cords.

* * * * *